US006060965A

United States Patent [19]

Sung et al.

[11] Patent Number: 6,060,965

[45] Date of Patent: May 9, 2000

[54] DIELECTRIC RESONATOR AND FILTER INCLUDING CAPACITOR ELECTRODES ON A NON-CONDUCTIVE SURFACE

[75] Inventors: Hee Kyung Sung; Chang Hwa Lee; Tae Hong Kim; Sang Seok Lee; Tae Goo Choi, all of Daejeon, Rep. of Korea

[73] Assignees: Electronics and Telecommunications Research Institute, Daejeon; Korea Telecommunication Authority, Seoul, both of Rep. of Korea

[21] Appl. No.: 08/357,228

[22] Filed: Dec. 12, 1994

[30] Foreign Application Priority Data

Dec. 14, 1993 [KR] Rep. of Korea ..... 93-27682
Dec. 14, 1993 [KR] Rep. of Korea ..... 93-27683

[51] Int. Cl.[7] ..... H01P 1/205

[52] U.S. Cl. ..... 333/202; 333/206; 333/222

[58] Field of Search ..... 333/202, 206, 333/207, 222, 223, 202 DB

[56] References Cited

U.S. PATENT DOCUMENTS

| | | | |
|---|---|---|---|
| 5,113,310 | 5/1992 | Kuroki et al. | 333/202 X |
| 5,278,527 | 1/1994 | Kenoun et al. | 333/202 |
| 5,614,875 | 3/1997 | Jang et al. | 333/222 |

FOREIGN PATENT DOCUMENTS

| | | | |
|---|---|---|---|
| 73501 | 5/1982 | Japan | 333/202 DB |
| 4051602 | 2/1992 | Japan | 333/206 |
| 4051603 | 2/1992 | Japan | 333/206 |
| 4056501 | 2/1992 | Japan | 333/202 DB |
| 4095401 | 3/1992 | Japan | 333/202 DB |
| 4139901 | 5/1992 | Japan | 333/206 |
| 6172607 | 6/1994 | Japan | 333/206 |

*Primary Examiner*—Benny Lee
*Attorney, Agent, or Firm*—Jacobson, Price, Holman & Stern, PLLC

[57] ABSTRACT

A dielectric resonator includes a dielectric block having an open surface at one of the surfaces thereof, the remaining surfaces being plated with a conductor. The dielectric block has an inner conductor hole formed at a surface of the dielectric block opposite to the open surface, the inner conductor hole extending a predetermined depth toward the open surface such that it does not perforate through the open surface. An electrode pattern is formed on the open surface such that it faces an end surface of the inner conductor hole, the electrode pattern being adapted to provide an input/output capacitor. The dielectric block has a coupling window formed on a predetermined portion of one of the surfaces of the dielectric block, except for the open surface and the surface formed with the inner conductor hole, at a position adjacent to one of the open surface and the surface formed with the inner conductor hole. The coupling window is free of the plated conductor and adapted to control a coupling degree of the resonator to another resonator. Other embodiments include integral type filters having resonators in a single dielectric block.

14 Claims, 6 Drawing Sheets

DIELECTRIC RESONATOR AND FILTER INCLUDING CAPACITOR ELECTRODES ON A NON-CONDUCTIVE SURFACE

BACKGROUND OF THE INVENTION

1. Field of the Invention

The present invention relates to a radio frequency dielectric filter basically including a dielectric coaxial resonator, and more particularly to a dielectric resonator having a simple construction including a single dielectric block and electrodes formed on the surface of the dielectric block, and a filter employing such a dielectric resonator.

2. Description of the Prior Art

Generally, UHF-band dielectric filters are mainly employed in RF transmitting and receiving units of portable telephones today. Such dielectric filters use ¼ wavelength coaxial lines of TEM mode using a microwave dielectric exhibiting a high permittivity to achieve a compact microwave component.

It is desirable for terminal units of communication systems to be compact, which results in strong requirements for reducing the dimensions of the components of the terminal units.

In order to meet such requirements, there have been proposed various types of radio frequency filters using a dielectric. These conventional filters will now be described in conjunction with FIGS. 1 and 2.

FIG. 1 is a perspective view of a conventional filter using a dielectric. This filter includes unit dielectric resonators 101 coupled by capacitors. Coupling capacitors 106, each disposed between adjacent resonators 101, and capacitors 107, respectively constituting input and output capacitors of the filter, are constructed by electrodes 104 formed on a circuit board 105. The electrodes 104 on the circuit board 105 are connected to inner conductors 103, in holes which emerge at open surfaces 102 of the coaxial resonators 101, by means of conduction wires 108, respectively.

FIG. 2 is a perspective view of another conventional dielectric filter. This dielectric filter is a monoblock type dielectric filter including a single dielectric block. As shown in FIG. 2, the dielectric filter includes a dielectric block 201 and a plurality of holes 202 for forming coaxial resonators. By this construction including throughout holes 202, the distance between adjacent resonators is reduced, thereby achieving a compactness. In this case, holes 203 for attenuating the coupling degree have respective inner walls with no plated film. The input and output of the dielectric filter are constituted by capacitors which are constructed by inserting dielectric cylinders 204 made of a dielectric such as Teflon into resonators formed at opposite side portions of the filter, respectively. Each of the dielectric cylinders has a conduction rod 205 at its center portion.

However, the conventional dielectric filter construction of FIG. 1 has the disadvantages of a large volume and a complicated manufacturing process because the capacitors for coupling the resonators are constructed by forming electrode patterns 104 on the circuit board 105 separately provided, because it requires the conduction wires 108 for connecting the electrodes 104 to the inner conductors 103 of coaxial resonators, and because it also requires a package such as a metal case for providing a mechanical coupling between each resonator and the circuit board and providing input and output terminals.

Similarly, the dielectric filter construction of FIG. 2 has the disadvantages of a large volume and a complicated manufacturing process because each hole 203 for coupling degree attenuation should have an inner surface having no plated film, because the input and output capacitors are separately constructed by inserting the dielectric cylinders 204 with conduction rods 205 into resonators formed at opposite side portions of the filter, and because it also requires a package for providing the mechanical coupling.

SUMMARY OF THE INVENTION

Therefore, the object of the present invention is to solve the above-mentioned problems encountered in the prior art and, thus, to provide a dielectric resonator having a simple and compact construction including only a single dielectric block and an electrode pattern formed on the dielectric block.

Another object of the invention is to provide a dielectric resonator filter using resonators each having a simple and compact construction including only a single dielectric block and an electrode pattern formed on the dielectric block, the filter being capable of achieving coupling between resonators and forming input and output capacitors and input and output terminals without attaching any separate capacitor and input and output terminals, and thereby achieving compactness and a reduced cost.

In accordance with one aspect, the present invention provides a dielectric resonator comprising: a dielectric block having an open surface at one of the surfaces thereof, the remaining surfaces being plated with a conductor, the dielectric block including: an inner conductor hole formed at a surface of the dielectric block opposite to the open surface, the inner conductor hole extending a predetermined depth toward the open surface such that it does not perforate through the open surface; and an electrode pattern formed on the open surface such that it faces an end surface of the inner conductor hole, the electrode pattern being adapted to provide an input/output capacitor.

In accordance with another aspect, the present invention provides a dielectric resonator filter comprising: at least two coupled dielectric blocks each having an open surface at one of the surfaces thereof, the remaining surfaces being plated with a conductor, each of the dielectric blocks including: an inner conductor hole formed at a surface of each of the dielectric blocks opposite to the open surface, the inner conductor hole extending a predetermined depth toward the open surface such that it does not perforate through the open surface; and an electrode pattern formed on the open surface such that it faces an end surface of the inner conductor hole, the electrode pattern being adapted to provide an input/output capacitor.

In accordance with another aspect, the present invention provides a dielectric resonator filter comprising: a dielectric block having an open surface at one of surfaces thereof, the remaining surfaces being plated with a conductor, the dielectric block including: at least two spaced inner conductor holes formed at a surface of the dielectric block opposite to the open surface, each of the inner conductor hole extending a predetermined depth toward the open surface such that it does not perforate through the open surface; and electrode patterns formed on the open surface such that they face respective end surfaces of the inner conductor holes, the electrode patterns being adapted to provide an input capacitor and an output capacitor, respectively.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
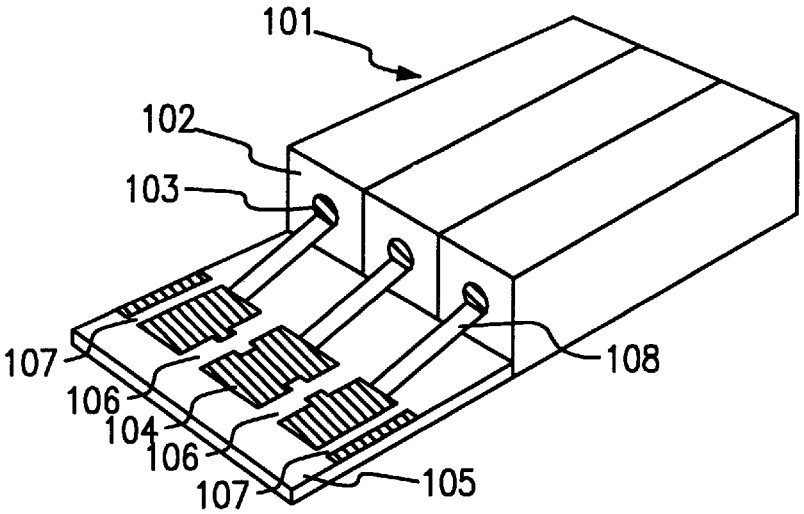
FIG. 1 (PRIOR ART)
FIG. 1 is a perspective view of a dielectric filter using conventional unit dielectric coaxial resonators.
Figure 2:
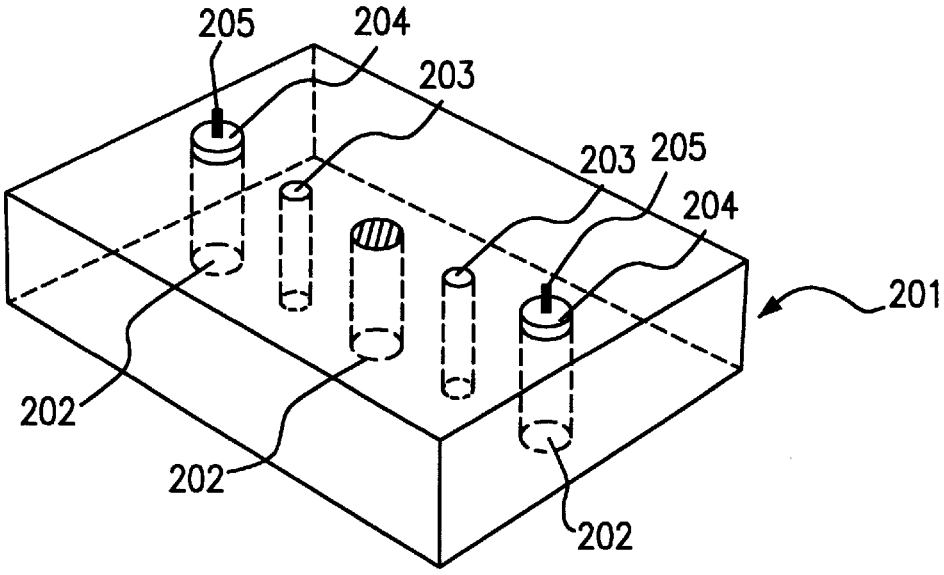
FIG. 2 (PRIOR ART)
FIG. 2 is a perspective view of another dielectric filter constituted by a conventional single dielectric block.
Figure 3:
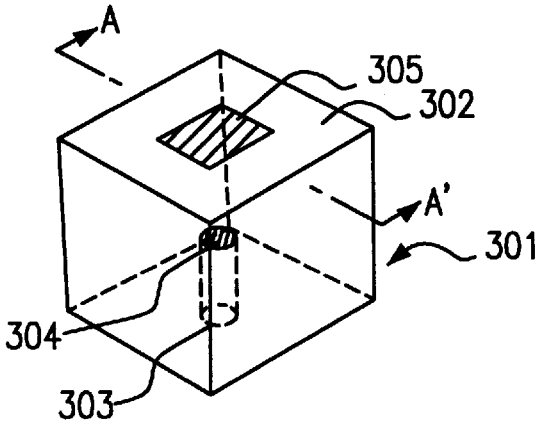
FIG. 3 is a perspective view of a dielectric resonator in accordance with an embodiment of the present invention.
Figure 4:
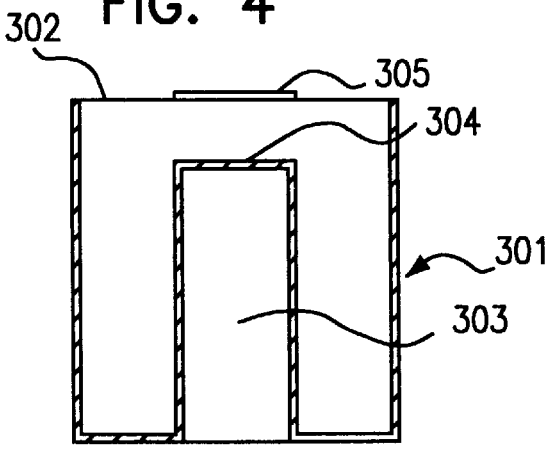
FIG. 4 is a cross-sectional view taken along the line A–A' of FIG. 3.

FIGS. 3 and 4 illustrate a unit dielectric resonator in accordance with an embodiment of the present invention.

FIG. 3 is a perspective view of the unit dielectric resonator and FIG. 4 is a cross-sectional view taken along the line A–A' of FIG. 3. In FIGS. 3 and 4, reference numeral 301 denotes a dielectric block, 302 denotes an open surface, 303 denotes a hole for an inner conductor, 304 denotes an electrode formed on the upper surface of the inner conductor hole, and 305 denotes an electrode formed on the open surface 302.

As shown in FIGS. 3 and 4, this embodiment is to provide a construction wherein the unit resonator has a capacitor for itself. The dielectric block 301 of the unit resonator has the open surface 302 at its upper surface. The dielectric block 301 also has a short circuit surface at its surface opposite to the open surface 302. All surfaces of the dielectric block 301 except for the open surface 302 are plated. The inner conductor hole 303 is formed at the short circuit surface of the dielectric block 301. The inner conductor hole 303 extends toward the open surface 302 to a predetermined depth such that it does not perforate through the open surface 302. The inner conductor hole 303 is plated so that it serves as a coaxial resonator.

The inner conductor hole 303 may have various shapes such as a circular shape, a elliptical shape and a quadrilateral shape.

The electrode 305 has a predetermined size and is attached to the open surface 302 such that it faces the upper surface electrode 304 of the inner conductor hole 303 so as to constitute a capacitor.

Thus, the capacitor is constituted by the electrode 305 on the open surface 302 and the electrode 304 on the upper surface of inner conductor hole 303. Accordingly, the capacitance of this capacitor is determined depending on the thickness of dielectric block defined between the electrode 305 and the electrode 304 of inner conductor hole 303 and the surface area of the electrode 305.

Figure 5:
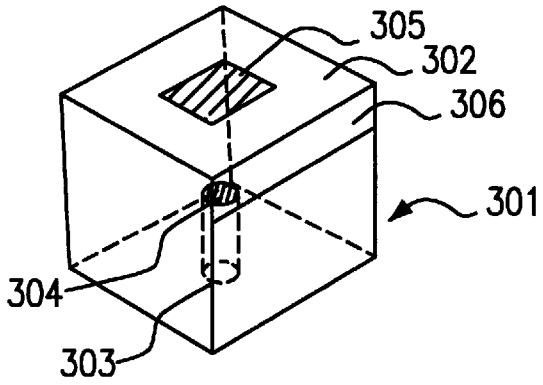
FIG. 5 is a perspective view of a dielectric resonator in accordance with another embodiment of the present invention.

Referring to FIG. 5, there is illustrated a unit dielectric resonator in accordance with another embodiment of the present invention. In FIG. 51 elements respectively corresponding to those in FIGS. 3 and 4 are denoted by the same reference numerals and are not described in detail herein. This dielectric resonator has the same construction as that of FIGS. 3 and 4 except for the provision of a coupling window 306. As shown in FIG. 5, the coupling window 306 is formed by removing a predetermined portion of the plated film on one of the side surfaces of the dielectric block 301. The coupling window 306 may be disposed at a position adjacent to the open surface 302 or the short circuit surface. The coupling degree between adjacent resonators is determined by the area of coupling window 306.

By coupling coaxial resonators each having the above-mentioned construction of FIG. 3 or FIG. 5, a dielectric filter is constructed. In order to obtain an appropriate operation of the filter, the coupling among the coaxial resonators should be appropriately achieved. A resonator coupling in accordance with an embodiment of the present invention will be described in conjunction with FIGS. 6 and 7.

Figure 6:
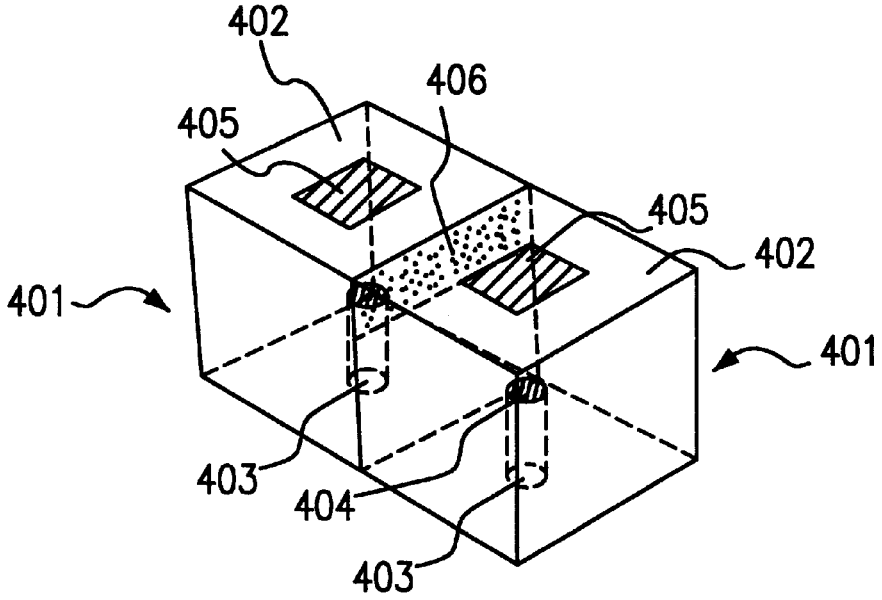
FIG. 6 is a perspective view illustrating a 2-pole dielectric band-pass filter constituted by the unit resonators of FIG. 5.

FIG. 6 is a perspective view illustrating a 2-pole dielectric band-pass filter constituted by the unit resonators of FIG. 5.

In FIG. 6, the filter includes a pair of dielectric blocks 401 each having an inner conductor hole 403 and a coupling window 406. The inner conductor hole 403 of each dielectric block 401 terminates in an electrode 404 which is capacitively coupled to an electrode 405 on the open surface 402 of the dielectric block 401. The coupling window 406 of each dielectric block 401 is formed by removing the upper portion of a plated film on one side surface of the dielectric block 401. The dielectric blocks 401 are in contact with each other at their coupling windows 406, thereby obtaining a capacitor coupling therebetween. The coupling degree between resonators respectively constituted by the dielectric blocks 401 can be controlled by varying the area of each coupling window 406. Although the filter has been described as including only two resonators, it may have more. The number of resonators is determined depending on the required standard of the filter.

Thus, a 2-pole or 3-pole band-pass filter may be constructed by providing the required number of dielectric blocks each having the coupling window and coupling the dielectric blocks.

Figure 7:
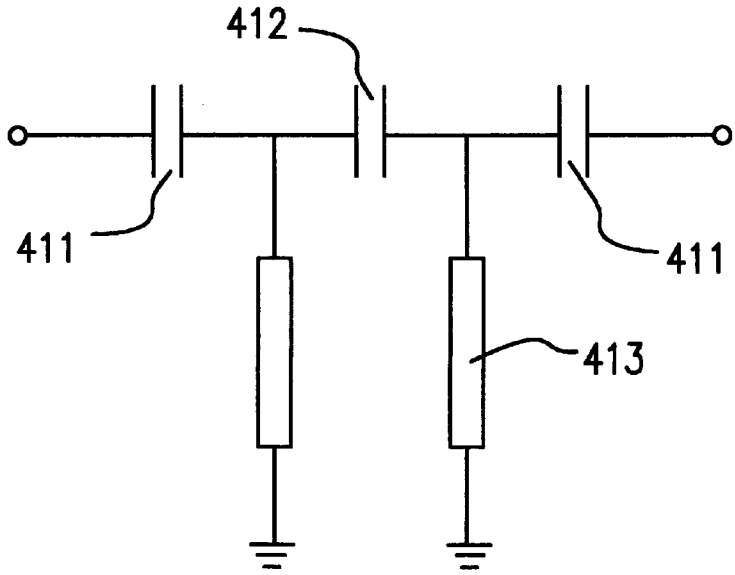
FIG. 7 is a circuit diagram illustrating an electrically equivalent circuit of the filter of FIG. 6.

FIG. 7 is a circuit diagram illustrating an electrically equivalent circuit of the filter of FIG. 6. In FIG. 7, the reference numeral 411 denotes input and output capacitors, 412 denotes a resonator-coupling capacitor, and 413 denotes coaxial resonators.

Figure 8:
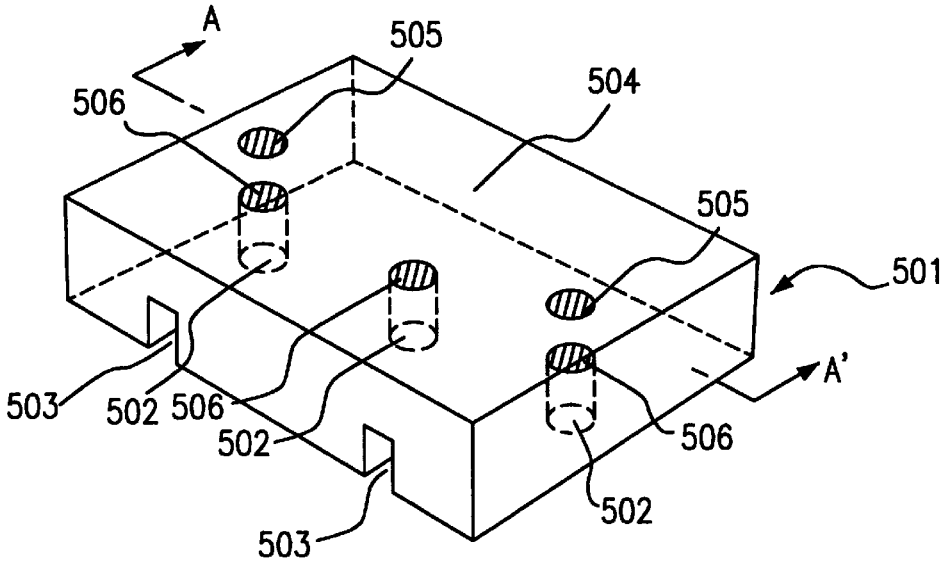
FIG. 8 is a perspective view of an integral type dielectric resonator filter in accordance with a further embodiment of the present invention.
Figure 9:
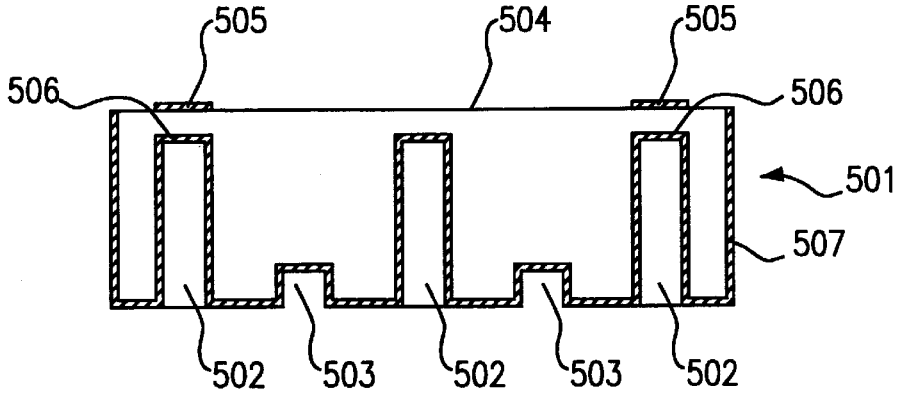
FIG. 9 is a cross-sectional view taken along the line A–A' of FIG. 8.
Figure 10:
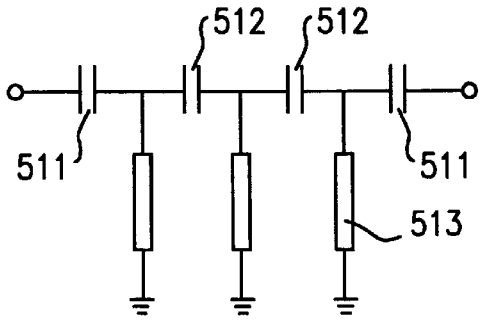
FIG. 10 is a circuit diagram illustrating an electrically equivalent circuit of the filter of FIG. 8.

FIGS. 8 to 10 illustrate an integral type filter constructed by dielectric resonators each having the construction of FIG. 3, respectively.

FIG. 8 is a perspective view of the integral type dielectric resonator filter in accordance with an embodiment of the present invention. FIG. 9 is a cross-sectional view taken along the line A–A' of FIG. 8. FIG. 10 is a circuit diagram illustrating an electrically equivalent circuit of the filter of FIG. 8. In FIGS. 8 and 9, the reference numeral 501 denotes a dielectric block, 502 denotes inner conductor holes, 503 denotes grooves for coupling degree attenuation, 504 denotes an open surface, 505 denotes electrodes formed on the open surface 504, and 506 denotes electrodes each formed on the upper surface of each inner conductor hole 502. In FIG. 10, the reference numeral 511 denotes input and output capacitors, 512 denotes resonator-coupling capacitors, and 513 denotes coaxial resonators.

As shown in FIGS. 8 to 10, this embodiment is to provide an integral type dielectric filter having three poles. The dielectric block 501 constituting the filter has an open surface 504 at its upper surface. All surfaces of the dielectric block 501 except for the open surface 504 are plated, which is denoted by reference number 507 as depicted in FIG. 9. The dielectric block 501 has at least two inner conductor holes 502 formed at the lower surface of dielectric block 501 and arranged along a transverse axis on the lower surface of dielectric block 501. Each inner conductor hole 502 extends upwards to a predetermined length so as to serve as an coaxial resonator. Electrodes 505 each have a predetermined size and are attached to both side portions of the open surface 504 such that they face the upper surface electrodes 506 of inner conductor holes 502, respectively. With this construction, a capacitor is formed between each of the electrodes 505 and each corresponding one of the upper surface electrodes 506 of inner conductor holes 502.

Coupling degree attenuating grooves 503 are formed at the lower surface of dielectric block 501. Each of the coupling degree attenuating grooves 503 is disposed at a predetermined position between adjacent inner conductor holes 502. Each coupling degree attenuating groove 503 extends from the front surface of dielectric block 501 to the rear surface of dielectric block 501 and has a plated film at its inner wall. The coupling degree attenuating grooves 503 serve to attenuate the coupling degree between adjacent resonators, thereby providing an appropriate coupling between the resonators. The coupling degree between adjacent resonators is controlled by adjusting the area and depth of the coupling degree attenuating groove 503.

The coupling between adjacent resonators is a capacitive coupling obtained by an electric field established through the dielectric disposed toward the open surface 504 of dielectric block 501. Each of input and output capacitors of the filter uses a capacitance obtained between each electrode 505 on the open surface 504 and each corresponding electrode 506 of inner conductor hole 502. The capacitance can be controlled by adjusting the dielectric thickness between the electrode 505 and the electrode 506 of inner conductor hole 502 and the area of the electrode 505.

The number of resonators, namely, coaxial lines, is determined depending on a desired standard of the filter. FIG. 10 shows the equivalent circuit for the dielectric filter of FIGS. 9 and 10. Reference number 511 denotes the input and output capacitors, 512 denotes resonator-coupling capacitors, and 513 denotes resonators.

Figure 11:
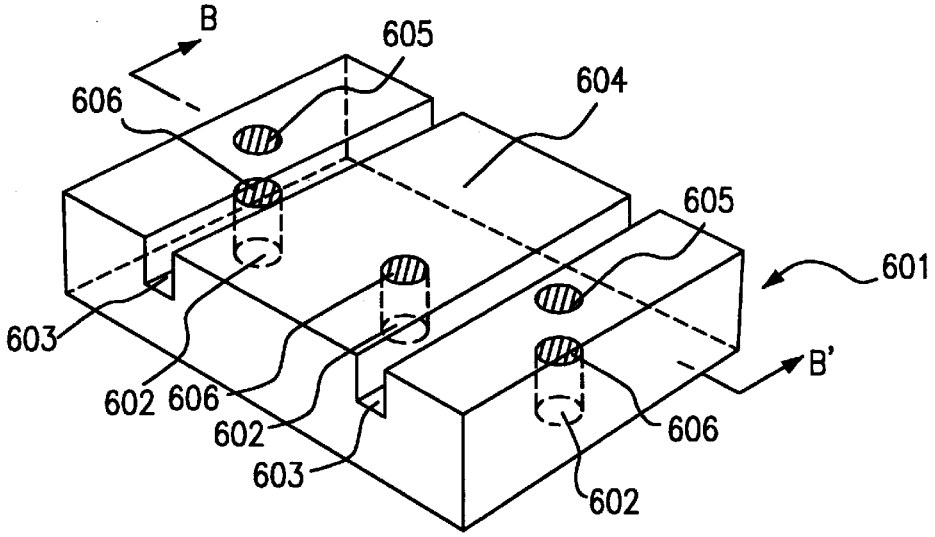
FIG. 11 is a perspective view of an integral type dielectric resonator filter in accordance with another embodiment of the present invention.
Figure 12:
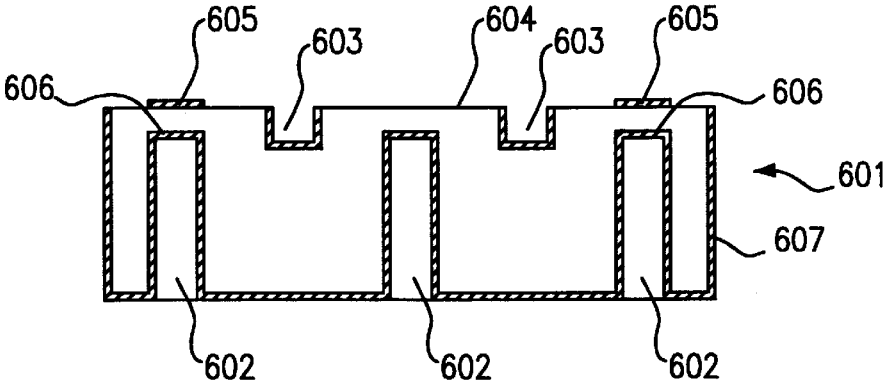
FIG. 12 is a cross-sectional view taken along the line B–B' of FIG. 11.
Figure 13:
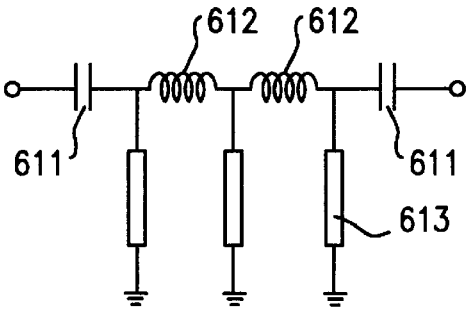
FIG. 13 is a circuit diagram illustrating an electrically equivalent circuit of the filter of FIG. 11.

FIGS. 11 to 13 illustrate an integral type dielectric resonator filter in accordance with another embodiment of the present invention.

FIG. 11 is a perspective view of the integral type dielectric resonator filter in accordance with this embodiment of the present invention. FIG. 12 is a cross-sectional view taken along the line B–B' of FIG. 11. FIG. 13 is a circuit diagram illustrating an electrically equivalent circuit of the filter of FIG. 11.

In FIGS. 11 and 12, reference numeral 601 denotes a dielectric block, 602 denotes inner conductor holes, 603 denotes coupling degree adjusting grooves, 604 denotes an open surface, 605 denotes electrodes formed on the open surface 604, 606 denotes electrodes each formed on the upper surface of each inner conductor hole 602, and 607 denotes plating. In FIG. 13, the reference numeral 611 denotes input and output capacitors, 612 denotes resonator-coupling inductors, and 613 denotes coaxial resonators.

As shown in FIGS. 11 and 12, the coupling degree adjusting grooves 603 are formed at the upper surface of dielectric block 501. Each of the coupling degree adjusting grooves 603 is disposed at a predetermined position between adjacent inner conductor holes 602. Each coupling degree adjusting groove 603 extends from the front surface of dielectric block 601 to the rear surface of dielectric block 601. The electrodes 605 are attached to both side portions of the open surface 604 such that they face the upper surface electrodes 606 of inner conductor holes 602, respectively. With this construction, an inductance coupling between adjacent resonators is obtained by a strong magnetic field established through the dielectric disposed toward the short circuit surface of dielectric block 601.

Similar to the above-mentioned case of the previous embodiment, the coupling degree between adjacent resonators is controlled by adjusting the area and depth of the coupling degree adjusting groove 603.

It should be noted that the use of coupling degree adjusting grooves as described above is not limited to filters having more than one resonator in a single dielectric block. Coupling degree adjusting grooves are also applicable to filters having resonators in different dielectric blocks, as in the arrangement shown in FIG. 6.

Figure 14:
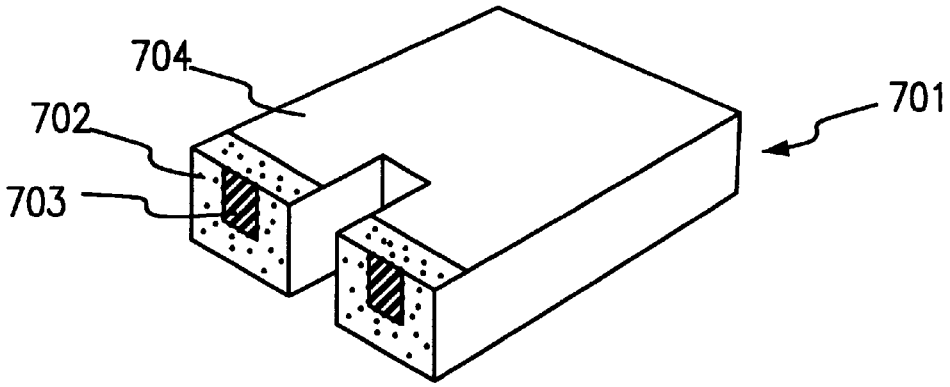
FIG. 14 is a perspective view of a dielectric resonator filter provided with electrodes which serve as input and output terminals in accordance with yet another embodiment.

FIG. 14 is a perspective view of a dielectric resonator filter provided with electrodes for input and output terminals in accordance with a further embodiment of the present invention.

The embodiment of FIG. 14 is to provide input and output terminals for modified versions of the embodiments of FIGS. 8 to 13. As shown in FIG. 14, electrodes 703 are formed at an open surface 702 of the dielectric filter, which is denoted by the reference numeral 701, so as to form input and output capacitors, respectively. Each of the electrodes 703 extends to one end of the open surface 702. Each electrode 703 faces an inner electrode (not shown), thereby providing a capacitor using a capacitance obtained through the dielectric between the electrode 703 and the inner electrode.

Accordingly, the electrodes 703 can be used as surface-mounting input and output terminals, respectively, without requiring any separate input and output terminals. In order to prevent a short circuit from occurring between each electrode 703 and each corresponding outer electrode 704, the outer electrode 704 is partially removed at its portion disposed adjacent to the electrode 703. Alternatively, this may be achieved by selectively plating the outer electrode 704 such that the portion of outer electrode 704 has no plated film.

Figure 15:
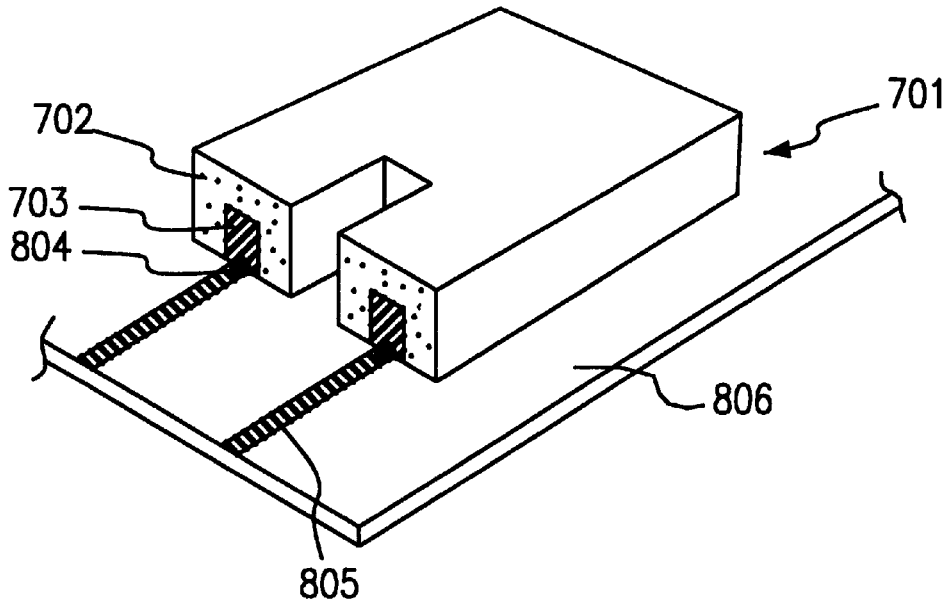
FIG. 15 is a perspective view illustrating the filter of FIG. 14 in a mounted condition.

FIG. 15 is a perspective view illustrating the filter of FIG. 14 in a mounted condition. As shown in FIG. 15, the filter 701 is mounted on a printed circuit board 806 by means of solder 804 which connects the electrodes 703 to conductors 805.

As will be apparent from the above description, the embodiments of FIGS. 9–13 provide a filter having a simple and compact construction including only a single dielectric block and an electrode pattern formed on the dielectric block.

In accordance with the embodiment of FIGS. 14 and 15, each of input and output terminals for the filter is formed in the form of an electrode on the open surface of the dielectric block. Accordingly, each terminal is also used as an electrode for a capacitor of the filter. Since the filter can be fabricated without being externally attached to any separate terminal and capacitor, it has the advantages of compactness, simplified fabrication, easy mounting and high integration.

Although the preferred embodiments of the invention have been disclosed for illustrative purposes, those skilled in the art will appreciate that various modifications, additions and substitutions are possible, without departing from the scope and spirit of the invention as recited in the accompanying claims.

What is claimed is:

1. A dielectric resonator comprising:

a dielectric block having an open surface at one of a plurality of surfaces thereof, the dielectric block additionally having an inner hole that emerges at a surface of the dielectric block opposite to the open surface, the inner hole extending a predetermined depth into the dielectric block and toward the open surface such that the inner hole does not perforate through the open surface;

a conductive coating which substantially covers the plurality of surfaces of the dielectric block except for the open surface, the conductive coating extending into the inner hole; and an electrode pattern disposed on the open surface such that the electrode pattern faces an end surface of the inner hole, the electrode pattern cooperating with a portion of the conductive coating at the end surface of the inner hole to provide an input/output capacitor.

2. A dielectric resonator filter, comprising:

a first dielectric resonator which includes a dielectric block having an open surface at one of a plurality of surfaces thereof, the dielectric block additionally havinq an inner hole that emerges at a surface of the dielectric block opposite to the open surface, the inner hole extending a predetermined depth into the dielectric block and toward the open surface such that the inner hole does not perforate through the open surface, a conductive coating which substantially covers the dielectric block except for the open surface, the conductive coating extending into the inner hole, and an electrode pattern disposed on the open surface such that the electrode pattern faces an end surface of the inner hole, the electrode pattern cooperating with a portion of the conductive coating at the end surface of the inner hole to provide an input/output capacitor; and a second dielectric resonator which includes a dielectric block having an inner hole and a conductive coating that extends into the inner hole of the dielectric block of the second dielectric resonator, wherein the dielectric block of the first dielectric resonator has a first coupling window disposed on a predetermined portion of one of the plurality of surfaces of the dielectric block of the first dielectric resonator, other than the open surface and the surface opposite to the open surface, at a position adjacent to one of the open surface and the surface opposite to the open surface, the first coupling window being free of the conductive coating on the dielectric block of the first dielectric resonator, wherein the dielectric block of the second dielectric resonator has a second coupling window, and wherein the first and second dielectric resonators are disposed so that the first and second coupling windows are positioned adjacent one another, with the first and second coupling windows controlling a coupling degree between the first dielectric resonator to the second dielectric resonator.

3. A dielectric resonator filter comprising:

at least two coupled dielectric resonators, each of the coupled dielectric resonators including a respective dielectric block having a corresponding open surface at one of a plurality of surfaces thereof, the respective dielectric block additionally having a corresponding inner hole that emerges at a surface thereof opposite to the open surface thereof, the corresponding inner hole extending a predetermined depth into the respective dielectric block and toward the open surface thereof such that the corresponding inner hole does not perforate through the corresponding open surface, and a respective conductive coating which substantially covers the respective dielectric block except for the open surface thereof, the respective conductive coating extending into the corresponding inner hole; and wherein at least one of the coupled dielectric resonators further includes an electrode pattern disposed on the open surface of the respective dielectric block such that the electrode pattern faces an end surface of the inner hole in the respective dielectric block, the electrode pattern cooperating with a portion of the conductive coating at the end surface of the inner hole of the respective dielectric block to provide a corresponding input/output capacitor.

4. A dielectric resonator filter in accordance with claim 3, further comprising a respective coupling degree adjusting groove disposed at a predetermined surface portion of the filter between adjacent inner holes provided in the dielectric blocks, the coupling disagree adjusting groove controlling a coupling degree between resonators provided by the adjacent inner holes.

5. A dielectric resonator filter in accordance with claim 3, wherein each of the inner holes has a respective shape selected from a circular shape, an elliptical shape and a quadrilateral shape.

6. A dielectric resonator filter comprising:

a dielectric block having an open surface at one of a plurality of surfaces thereof, the dielectric block additionally having at least two spaced inner holes that emerge at a surface of the dielectric block opposite to the open surface, each of the inner holes respectively extending a predetermined depth into the dielectric block and toward the open surface such that the respective inner hole does not perforate through the open surface;

a conductive coating which substantially covers the dielectric block except for the open surface, the conductive coating extending into the respective inner holes; and electrode patterns disposed on the open surface such that the electrode patterns respectively face end surfaces of the corresponding inner holes, the electrode patterns respectively cooperating with portions of the conductive coating at the corresponding end surfaces to provide an input capacitor and an output capacitor.

7. A dielectric resonator filter in accordance with claim 6, further comprising a coupling degree adjusting groove disposed at a predetermined surface portion of the dielectric block between adjacent ones at the inner holes, the coupling degree adjusting groove controlling a coupling degree between resonators respectively constituted by the adjacent ones of the inner holes.

8. A dielectric resonator filter in accordance with claim 6, wherein the dielectric block has an edge where the open surface of the dielectric block meets another of the surfaces of the dielectric block, and wherein each of the electrode patterns extends to said edge of the dielectric block to provide a corresponding terminal for a connection of the filter to a surface-mounting circuit board.

9. A dielectric resonator filter in accordance with claim 8, further comprising means for preventing a short circuit between each of the terminals and the conductive coating, the means including regions of the another of the surface of the dielectric block, adjacent said edges which are free of the conductive coating.

10. A dielectric filter, comprising:

a dielectric block having a bottom surface, a top surface which is disposed opposite the bottom surface, and a plurality of side surfaces which extend from the bottom surface to the top surface, the dielectric block additionally having a row of holes which extend from the bottom surface into the dielectric block and which terminate at respective inner ends that are spaced apart from the top surface, the row of holes including a first hole at a first end of the row, a second hole at a second end of the row, and an intermediate hole between the first and second holes;

a conductive coating which substantially covers the bottom surface and at least one of the side surfaces but which leaves the top surface substantially uncovered, the conductive coating extending into the first, second, and intermediate holes; and a plurality of electrodes disposed in a predetermined pattern on the upper surface, the pattern including an input electrode disposed over the inner end of the first hole and an output electrode disposed over the inner end of the second hole but having no electrode disposed over the inner end of the intermediate hole.

11. A dielectric filter in accordance with claim 10, wherein the bottom surface of the dielectric block has a plurality of coupling degree adjustment grooves.

12. A dielectric filter in accordance with claim 10, wherein the top surface of the dielectric block has a plurality of coupling degree adjustment grooves.

13. A dielectric filter in accordance with claim 10, wherein the dielectric block additionally has an edge where the top surface meets a predetermined one of the side surfaces, and wherein the input and output electrodes extend to said edge to provide respective surface mounting terminals.

14. A dielectric filter in accordance with claim 10, wherein all of the side surfaces are substantially covered by the conductive coating.

* * * * *